US005421521A

United States Patent [19]

Gibson et al.

[11] Patent Number: 5,421,521

[45] Date of Patent: Jun. 6, 1995

[54] FUEL INJECTION NOZZLE HAVING A FORCE-BALANCED CHECK

[75] Inventors: Dennis H. Gibson, Chillicothe; Ronald D. Shinogle, Peoria, both of Ill.

[73] Assignee: Caterpillar Inc., Peoria, Ill.

[21] Appl. No.: 290,043

[22] Filed: Aug. 12, 1994

Related U.S. Application Data

[63] Continuation of Ser. No. 172,881, Dec. 23, 1993, abandoned.

[51] Int. Cl.[6] ..... F02M 47/00

[52] U.S. Cl. ..... 239/585.4

[58] Field of Search ..... 239/523.2–533.12, 239/585.1–585.5, 900; 251/30.01, 30.02, 30.03, 42, 43

[56] References Cited

U.S. PATENT DOCUMENTS

| | | | |
|---|---|---|---|
| Re. 33,270 | 7/1990 | Beck et al. | 123/447 |
| 3,175,771 | 3/1965 | Breting | 239/533 |
| 3,241,768 | 3/1966 | Croft | 239/124 |
| 3,361,161 | 1/1968 | Schwartz | 137/604 |
| 3,443,760 | 5/1969 | Simmons | 239/410 |
| 3,450,353 | 6/1969 | Eckert | 239/585 |
| 3,532,121 | 10/1970 | Sturman et al. | 137/625.4 |
| 3,570,806 | 3/1971 | Sturman et al. | 251/65 |
| 3,570,807 | 3/1971 | Sturman et al. | 251/65 |
| 3,570,833 | 3/1971 | Sturman et al. | 267/161 |
| 3,585,547 | 6/1971 | Sturman et al. | 335/227 |
| 3,592,568 | 7/1971 | Fenne | 417/540 |
| 3,604,959 | 9/1971 | Sturman | 310/12 |
| 3,661,130 | 5/1972 | Eheim | 123/140 A |
| 3,683,239 | 8/1972 | Sturman | 317/150 |
| 3,742,918 | 7/1973 | Murtin et al. | 123/32 EA |
| 3,743,898 | 7/1973 | Sturman | 317/154 |
| 3,821,967 | 7/1974 | Sturman et al. | 137/624.15 |
| 3,989,066 | 11/1976 | Sturman et al. | 137/624.2 |
| 4,040,569 | 8/1977 | Knapp | 239/467 |
| 4,064,855 | 12/1977 | Johnson | 123/139 DP |
| 4,096,995 | 6/1978 | Komp | 239/533.8 |
| 4,107,546 | 8/1978 | Sturman et al. | 307/141 |
| 4,108,419 | 8/1978 | Sturman et al. | 251/30 |
| 4,114,647 | 9/1978 | Sturman et al. | 137/624.2 |
| 4,120,456 | 10/1978 | Kimura et al. | 239/464 |
| 4,192,466 | 3/1980 | Tanasawa et al. | 239/464 |
| 4,258,674 | 3/1981 | Wolff | 123/446 |
| 4,269,360 | 5/1981 | Kopse | 239/533.8 |
| 4,343,280 | 8/1982 | Luscomb | 123/459 |
| 4,392,612 | 7/1983 | Deckard et al. | 239/88 |
| 4,409,638 | 10/1983 | Sturman et al. | 361/152 |
| 4,417,557 | 11/1983 | Walter | 123/467 |
| 4,482,094 | 11/1984 | Knape | 239/88 |
| 4,498,625 | 2/1985 | Schechter | 239/5 |
| 4,501,290 | 2/1985 | Sturman et al. | 137/495 |
| 4,516,600 | 5/1985 | Sturman et al. | 137/495 |
| 4,541,454 | 9/1985 | Sturman et al. | 137/505 |
| 4,561,701 | 12/1985 | Fujii et al. | 303/119 |
| 4,568,021 | 2/1986 | Deckard et al. | 239/88 |
| 4,580,598 | 4/1986 | Itoh | 137/596.17 |
| 4,586,656 | 5/1986 | Wich | 239/88 |

(List continued on next page.)

FOREIGN PATENT DOCUMENTS

| | | |
|---|---|---|
| 0246373A1 | 11/1987 | European Pat. Off. . |
| 922938 | 4/1963 | United Kingdom . |

OTHER PUBLICATIONS

SAE Paper No. 840273, "Direct Digital Control of Electronic Unit Injectors," by Beck et al. (BKM, Inc.) Feb. 27–Mar. 2, 1984.

(List continued on next page.)

*Primary Examiner*—Andres Kashnikow
*Assistant Examiner*—Kevin P. Weldon
*Attorney, Agent, or Firm*—Mark D. Becker

[57] ABSTRACT

A check valve assembly for a fuel injector includes an injector body having an injector bore therein, an elongate check disposed within the injector bore and an actuator for moving the check along an axial path between a sealing position and an open position. Axial forces acting on the check are balanced during movement between the sealing and open positions so that direct control over the check position may be accomplished through the use of a low-force actuator.

15 Claims, 3 Drawing Sheets

U.S. PATENT DOCUMENTS

| | | | |
|---|---|---|---|
| 4,628,881 | 12/1986 | Beck et al. | 123/447 |
| 4,635,854 | 1/1987 | Ishibashi | 239/533.8 |
| 4,635,854 | 1/1987 | Ishibashi | 239/533.8 |
| 4,671,232 | 6/1987 | Stumpp et al. | 123/300 |
| 4,681,080 | 7/1987 | Schukoff | 123/506 |
| 4,709,679 | 12/1987 | Djordjevic et al. | 123/447 |
| 4,714,066 | 12/1987 | Jordan | 123/447 |
| 4,721,253 | 1/1988 | Noguchi et al. | 239/464 |
| 4,777,921 | 10/1988 | Miyaki et al. | 123/456 |
| 4,782,807 | 11/1988 | Takahashi | 123/506 |
| 4,811,221 | 3/1989 | Sturman et al. | 364/420 |
| 4,831,989 | 5/1989 | Haines | 123/506 |
| 4,838,232 | 6/1989 | Wich | 123/506 |
| 4,840,160 | 6/1989 | Zipprath et al. | 123/467 |
| 4,870,940 | 10/1989 | Filippi et al. | 123/506 |
| 4,934,599 | 6/1990 | Hasagawa | 239/88 |
| 4,946,103 | 8/1990 | Ganser | 239/88 |
| 4,964,571 | 10/1990 | Taue et al. | 239/88 |
| 4,993,637 | 2/1991 | Kanesaka | 239/96 |
| 5,007,584 | 4/1991 | Rossignol | 239/88 |
| 5,046,472 | 9/1991 | Linder | 239/585.4 |
| 5,072,882 | 12/1991 | Taue et al. | 239/88 |
| 5,094,215 | 3/1992 | Gustafson | 123/500 |
| 5,109,822 | 5/1992 | Martin | 123/456 |
| 5,121,730 | 6/1992 | Ausman et al. | 123/467 |
| 5,133,645 | 7/1992 | Crowley et al. | 417/279 |
| 5,141,164 | 8/1992 | Ohno et al. | 239/585.2 |
| 5,155,461 | 10/1992 | Teerman et al. | 335/260 |
| 5,156,132 | 10/1992 | Iwanaga | 123/496 |
| 5,201,295 | 4/1993 | Kimberley et al. | 123/467 |
| 5,221,046 | 6/1993 | Timmer | 239/88 |
| 5,230,613 | 7/1993 | Hilsbos et al. | 417/439 |
| 5,271,563 | 12/1993 | Gerny et al. | 239/585.4 |

OTHER PUBLICATIONS

"SERVOJET Electronic Fuel Injection HSV High Speed Solenoid Valves," four page except reprinted from vol. 50, Diesel & Gas Turbine Worldwide Catalog, 1985 Edition.

SAE Paper No. 900639, "Injection Rate Shaping and High Speed Combustion Analysis–New Tools for Diesel Engine Combustion Development," by Beck et al. (BKM, Inc.; PEI Consultants), Feb. 26–Mar. 2, 1990.

Proc. Instn. Mech. Engrs., vol. 204, "The injection equipment of future high–speed DI diesel engines with respect to power and pollution requirements," by Dolenc (Monobloc Dieselmotoren G.m.g.HH.), Mar. 20, 1990.

SAE Paper No. 910184, "Application of a High Flexible Electronic Injection System to a Heavy Duty Diesel Engine," by Racine et al. (Renault Vehicules Industriels), Feb. 25–Mar. 1, 1991.

SAE Paper No. 910252, "Development of New Electronically Controlled Fuel Injection System ECD–U2 for Diesel Engines,"]by Miyaki et al. (Nippondenso Co., Ltd.), 1991.

SAE Paper No. 940897, "Reducing Particulate and $NO_x$ Emissions by Using Multiple Injections in a Heavy Duty D.I. Diesel Engine," by Tow et al. (U. of Wisconsin–Madison), Feb. 28–Mar. 3, 1994.

15th Annual Vienna Motor Symposium, pp. 36–53, "Common Rail Injection System for Diesel Engines–Analysis, Potential, Future," by Egger et al. (Robert Bosch G.m.b.H), Apr. 28≧29, 1994.

15th Annual Vienna Motor Symposium, pp. 54–79, "Common Rail Injection Systems with Characteristics Independent of Engine Speed and with High Injection Pressure–Diesel Engine Potential for the Future," by Prescher et al. (IMH–Institut fur Motorenbau Prof. Huber GmgH), Apr. 28–29, 1994.

15th Annual Vienna Motor Symposium, pp. 96–115, "Latest Findings in Development of High–Speed Direct Injection [HSDI] Diesel Engines in Passenger Vehicles," by Cichocki et al. (AVL–List GmbH), Apr. 28–29, 1994.

FUEL INJECTION NOZZLE HAVING A FORCE-BALANCED CHECK

This is a continuation of U.S. application Ser. No. 08/172,881, filed Dec. 23, 1993, now abandoned.

TECHNICAL FIELD

The present invention relates generally to fuel injection systems and, more particularly, to a fuel injector which can be directly operated by a low-force actuator.

BACKGROUND ART

Prior fuel injection systems which may be used with, for example, diesel engines, have typically been of the pump-line-injector type or the unit injector type. A pump-line-injector fuel injection system includes a main pump which pressurizes fuel to a high level, e.g., on the order of about 103 to 138 MPa (about 20,000 p.s.i.), and individual fuel injectors which are coupled by fuel supply lines to the pump. In a unit injector system, a low-pressure pump delivers fuel to a plurality of unit injectors, each of which includes means for pressurizing the fuel to a relatively high value, again on the order of about 103 to 138 MPa (about 15,000 to 20,000 p.s.i.) or greater.

In both types of injection systems, each injector conventionally includes a check having a tip which is biased by a spring against a valve seat. When fuel is to be injected into an associated engine combustion chamber, pressurized fuel is admitted into an injector cavity within the injector. When the fuel pressure in the cavity overcomes the spring force exerted on the check, the check is lifted, thereby spacing the check tip away from the valve seat and permitting pressurized fuel to escape into the associated engine combustion chamber through one or more injector nozzle orifices.

While conventional injection apparatus of the foregoing type have been useful to control the admittance of pressurized fuel into an associated engine combustion chamber relative to approximately top dead center (TDC), such apparatus is only indirectly controlled, i.e., the motive force for moving the injector check is provided by the pressurized fuel itself rather than a directly controllable motive power source. Accordingly, the degree of controllability required to desirably reduce particulate emissions in accordance with regulatory agency standards is lacking.

While there may be fuel injectors designed for spark-ignition engines which have a directly-operated check, Applicants are unaware of any successful designs for a fuel injector having a directly-operated check for a diesel-cycle engine or where high fuel injection pressures (e.g., greater than about 6.9 MPa or 1000 p.s.i.) are required.

DISCLOSURE OF THE INVENTION

A fuel injector includes a check which is force balanced so that the size of an actuator which controls the positioning of the check may be minimized.

More particularly, in accordance with one aspect of the present invention, a check valve for a fuel injector includes an elongate check disposed within an injector bore, an actuator for moving the check along an axial path between a sealing position and an open position and means for substantially balancing axial forces acting on the check during movement between the sealing and open positions.

According to a further aspect of the present invention, a check valve for a fuel injector includes an injector body having an injector bore including a guide bore section defined by a guide wall, a tip bore section defined by a tip wall and a valve seat disposed between the guide wall and the tip wall. A cylindrical elongate check is provided having a guide portion disposed within the guide wall, a tip portion disposed within the tip wall and a sealing portion between the guide portion and the tip portion and disposed adjacent the valve seat. An actuator moves the check along an axial path between a sealing position and an open position and means carried by at least one of the check and the injector body substantially balances axial forces acting on the check during movement between the sealing and open positions.

According to yet another aspect of the present invention, a fuel injector includes an injector body having an injector bore, an injector inlet in fluid communication with the injector bore for admittance of pressurized fuel therein and an injector nozzle orifice in fluid communication with the injector bore. A circular cylindrical elongate check is provided having a guide portion disposed at a first check end within a guide wall defining the injector bore, a tip portion disposed at a second check end within a tip wall defining the injector bore and a sealing portion between the guide portion and the tip portion and disposed adjacent a valve seat defining the injector bore. The guide portion and tip portion have substantially equal cross-sectional diameters. An annular groove is disposed between the sealing portion and the tip portion wherein the tip portion is spaced from the tip wall to provide a leakage path between the annular groove and the second check end. An actuator is provided for moving the check along an axial path between a sealing position wherein the sealing portion of the check is in contact with the valve seat and isolates the injector nozzle orifice from the injector inlet and an open position wherein the sealing portion is spaced from the valve seat to place the injector nozzle orifice in fluid communication with the injector inlet. Means carried by at least one of the check and the injector bore equalizes pressures acting on the first and second ends of the check such that axial forces acting thereon during movement between the sealing and open positions are substantially balanced.

By arranging the fuel injector such that forces developed on the check are substantially balanced, a low-force actuator which is relatively small and light in weight can be used. Also, because the check is directly controlled, a fuel injection regime may be used which results in a desirable reduction in particulates in the engine exhaust.

BEST MODE FOR CARRYING OUT THE INVENTION

Figure 1:
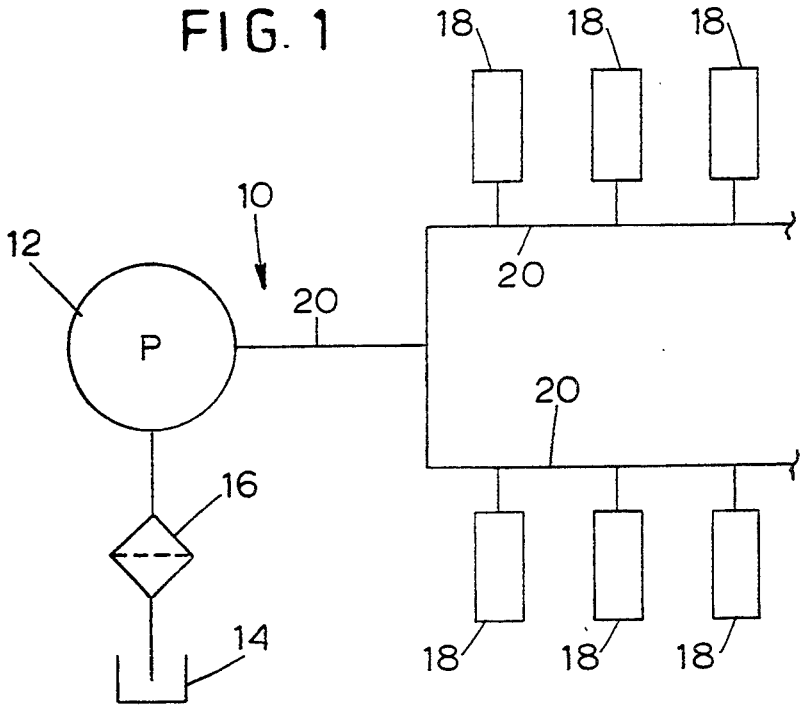
FIG. 1 comprises a combined schematic and block diagram of a fuel injection system.

Referring now to FIG. 1, a fuel injection system 10 includes a transfer pump 12 which receives fuel from a fuel tank 14 and a filter 16 and delivers same to one or more fuel injectors 18 via one or more fuel supply lines or conduits 20. The fuel injectors 18 inject fuel into associated combustion chambers or cylinders (not shown) of an internal combustion engine. While six fuel injectors 18 are shown in FIG. 1, it should be noted that a different number of fuel injectors may alternatively be used to inject fuel into a like number of associated combustion chambers. Also, the engine with which the fuel injection system 10 may be used may comprise a diesel-cycle engine, a an ignition-assisted engine or any other type of engine where it is necessary or desirable to inject fuel therein.

The fuel injection system 10 may comprise a pump-line-injector system wherein the pump 12 pressurizes the fuel flowing in the fuel lines 20 a relatively high pressure, for example about 138 MPa (about 20,000 p.s.i.). In this case, an internal check of each fuel injector 18 is controlled electronically, hydraulically and/or mechanically to release the pressurized fuel into the combustion chambers associated therewith. Alternatively, the system 10 may comprise a unit injector system wherein the pump 12 supplies fuel at a relatively low pressure of, for example about, 0.414 MPa (60 p.s.i.), to the injectors 18. The injectors 18 include means for pressurizing the fuel to a relatively high pressure of, for example about, 138 MPa (20,000 p.s.i.) and an internal check is operated to admit the pressurized fluid into the associated combustion chambers.

Figure 2:
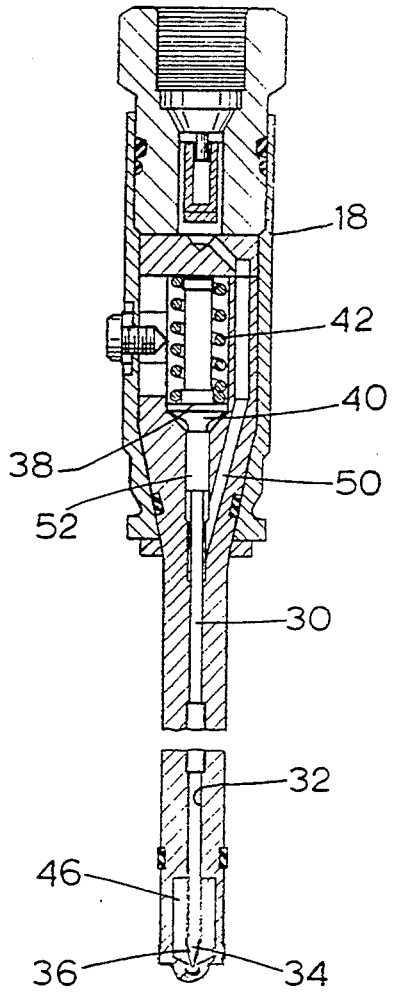
FIG. 2 PRIOR ART
FIG. 2 comprises an elevational view, partly in section, of a prior art fuel injector.
Figure 4:
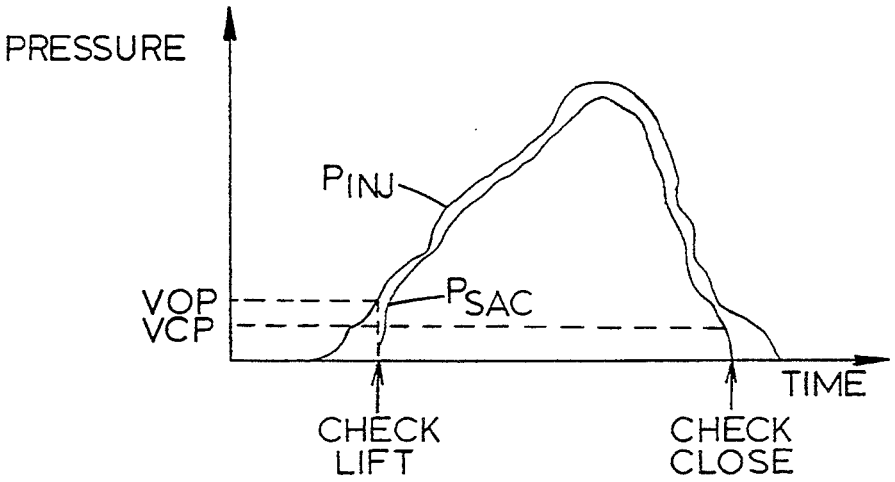
FIG. 4 PRIOR ART
FIG. 4 comprises a graph illustrating the operation of the fuel injector of FIG. 2.

FIG. 2 illustrates a prior art fuel injector 18 which is usable with the fuel injection system 10 of FIG. 1 configured as a pump-line-injector system. The fuel injector 18 includes a check 30 which resides within an injector bore 32 located in an injector body 33. The check 30 includes a sealing tip 34 disposed at a first end portion 36 of the check 30 and an enlarged plate or head 38 disposed at a second end portion 40 of the check 30. A spring 42 biases the tip 34 against a valve seat 44, shown in greater detail in FIG. 3, to isolate a fuel chamber 46 from one or more nozzle orifices 48.

The fuel injector 18 further includes a fuel inlet passage 50 which is disposed in fluid communication with one of the fuel supply lines 20.

Figure 3:
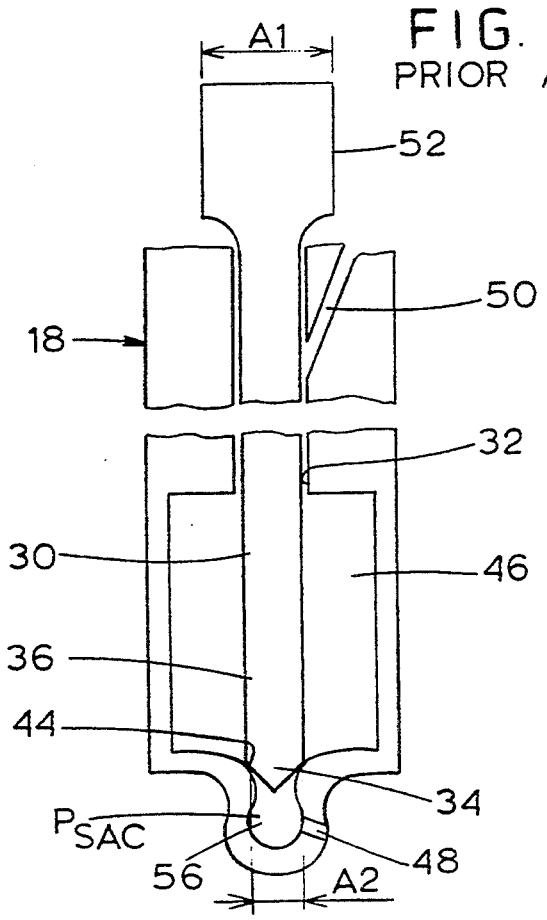
FIG. 3 PRIOR ART
FIG. 3 comprises an enlarged, fragmentary sectional view of the fuel injector of FIG. 2.

As seen specifically in FIG. 3, when fuel injection into an associated combustion chamber is to occur, pressurized fuel is admitted through the passage 50 into the space between the check 30 and the injector bore 32 and into the chamber 46. When the pressure $P_{INJ}$ within the chamber 46 reaches a selected valve opening pressure (VOP), check lift occurs, thereby spacing the tip 34 from the valve seat 44 and permitting pressurized fuel to escape through the nozzle orifice 48 into the associated combustion chamber. The pressure VOP is defined as follows:

$$VOP = \frac{S}{A1 - A2}$$

where S is the load exerted by the spring 42, A1 is the cross-sectional dimension of a valve guide 52 of the check 30 and A2 is the diameter of the line defined by the contact of the tip 34 with the valve seat 44.

At and following the moment of check lift, the pressure $P_{SAC}$ in an injector tip chamber 56 increases and then decreases in accordance with the pressure $P_{INJ}$ in the chamber 46 until a selected valve closing pressure (VOP) is reached, at which point the check returns to the closed position. The pressure VCP is determined in accordance with the following equation:

$$VCP = \frac{S}{A1}$$

where S is the spring load exerted by the spring 42 and where A1 is the cross-sectional diameter of the guide portion 52, as noted previously.

As the foregoing discussion demonstrates, opening and closing of the fuel injector 18 is accomplished only indirectly, i.e., by the force developed by the pressurized fuel admitted into the injector bore 32. One consequence of this fact is that the injector opening and closing pressures VOP and VCP are selected in advance by the overall design of the injector and cannot be readily changed. Further, the controllability of the injector 18 is severely limited, thereby limiting the opportunity to reduce particulate emissions through control thereof.

Figure 5:
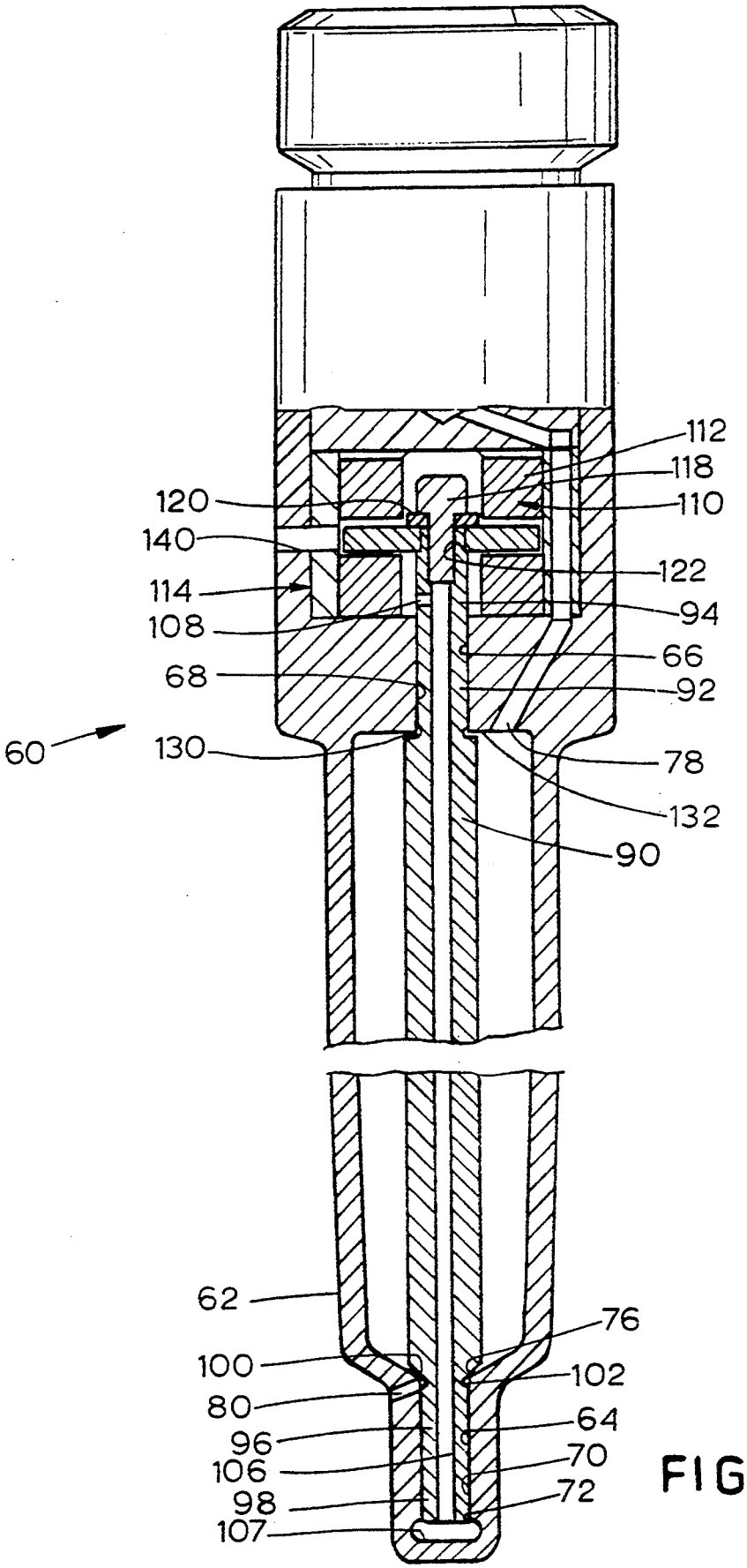
FIG. 5 comprises a sectional view of a fuel injector incorporating a force-balanced check according to the present invention.

FIG. 5 illustrates a fuel injector 60 according to the present invention which may be used in place of each fuel injector 18 in the pump-line-injector system of FIG. 1. Alternatively, the fuel injector 60 may be modified for use in a unit injector system in a fashion well-known to one of ordinary skill in the art.

The fuel injector 16 includes an injector body 62 including a circular cylindrical injector bore 64 therein. The injector bore 64 includes a guide bore section 66 defined by a guide wall 68, a tip bore section 70 defined by a tip wall 72 and a conical valve seat 76 disposed between the guide wall 68 and the tip wall 72. An injector inlet 78 is disposed in fluid communication with the injector bore 64 for the admittance of pressurized fuel therein.

A circular cylindrical elongate check 90 is disposed within the injector bore 64 and includes a guide portion 92 disposed at a first check end 94 within the guide wall 68 and a tip portion 96 disposed at a second check end 98 within the tip wall 72. A sealing portion 100 is disposed between the guide portion 92 and the tip portion 96 and is disposed adjacent the valve seat 76. An annular groove 102 surrounds the check 90 and is located between the sealing portion 100 and the tip portion 96 adjacent the injector nozzle orifice 80.

The tip portion 96 preferably has an outer diameter which is slightly less than the diameter of the tip wall 72 so that a leakage path is established between the annular groove 102 and the second check end 98.

Means are carried by at least one of the check 90 and the injector body 62 for equalizing pressures acting on the first and second ends 94, 98 of the check 90 such that axial forces acting thereon during movement between sealing and open positions are substantially balanced. Preferably, such means comprises a longitudinal bore 106 extending through the check from an injector bore end 107 to the first check end 94. In the embodiment illustrated in FIG. 5, a radial hole 108 extends from the longitudinal bore 106 to the guide bore section 66.

An actuator 110 is coupled to the check 90 and moves the check along a reciprocal or axial path between the sealing and open positions. In the preferred embodiment, the actuator 110 comprises first and second solenoids 112, 114 which include a common armature 116 connected by means of a screw 118 and a washer 120 to a threaded bore 122 in the check 90. In the embodiment shown in FIG. 5, the threaded bore 122 has a centerline coincident with the centerline of the longitudinal bore 106, although this need not be the case. Also, any other way of connecting the armature 116 to the check 90 may alternatively be used, such as laser welding, or the like.

INDUSTRIAL APPLICABILITY

The check 90 of FIG. 5 is shown in the closed or sealing position wherein the sealing portion 100 is in sealed contact with the valve seat 76 to thereby isolate the injector nozzle orifice(s) 80 from the injector inlet 78. When it is desired to inject pressurized fuel into the associated combustion chamber, the solenoid 112 is electrically actuated and the solenoid 114 is electrically deactuated so that the common armature 116 and the check 90 are moved together in the upward direction as seen in FIG. 5 until a shoulder 130 carried by the check 90 contacts a transverse wall 132 of the injector body 62. The check 90 is thus moved to the open position wherein the sealing portion 100 is spaced from the valve seat 76 to place the injector nozzle orifice(s) 80 in fluid communication with the injector inlet 78. In this position, pressurized fuel may pass through the leakage path between the tip wall 72 and the tip portion 96 upwardly through the longitudinal bore 106 and the radial hole 108 to the guide bore section 66. Preferably, the effective cross-sectional area or diameter of the guide portion 92 is substantially equal to the effected cross-sectional area or diameter of the tip portion 96. Also preferably, these diametral dimensions are substantially equal to the inner diameter of the valve seat 76, except for the slight spacing required to create the leakage path between the tip portion 96 and the tip wall 72. By equalizing the fluid pressures acting in the guide bore section 66 and the tip bore section 70, the net axial opposing forces acting on the first and second check ends 94, 98 are equalized, thereby permitting direct control over the open/closed status of the check 90 using a relatively low-force actuator 110. Fuel is vented from the cavity containing the solenoids 112, 114 by a drain port 140.

When it is desired to end fuel injection, the solenoid 112 is electrically deactuated and the solenoid 114 is electrically actuated to move the armature 116 and the check 90 downwardly as seen in FIG. 5 to cause the sealing portion 100 to contact the valve seat 76 in sealing relationship. Continued balancing of fluid pressures acting on the first and second ends 94, 98 of the check 90 is assured by the fluid communication afforded by the longitudinal bore 106 and the radial hole 108.

It should be noted that, instead of the longitudinal bore 106 and the radial hole 108, fluid communication between the first and second check ends 94, 98 may be accomplished by any other means, including a single passages extending through the check 90 and/or one or more bores extending through the injector body 62. Further, the pair of solenoids 112, 114 may be replaced by any other kind of mechanical, electrical or hydraulic actuator, including an actuator that utilizes a single solenoid for movement of the check in a first direction and a return spring for moving the check in a second direction.

Because the actuator 110 need only develop low motive forces to control the check position, an actuator which is small and relatively light in weight may be used. In addition, the direct control over check position permits the injector to be utilized in injection regimes which cannot be accomplished by the conventional actuator of FIG. 2. For example, split injection may be accomplished by the injector of FIG. 5 wherein multiple openings and closings of the check 90 are undertaken during each injection cycle of the engine combustion chamber associated therewith. Further, the pressure $P_{INJ}$ can be controlled independently of check actuation so that the injector 60 can be used in other types of systems, such as a constant pressure system or an accumulator system, if desired.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A check valve for a fuel injector, comprising:

an injector body having an injector bore defined by a guide wall, a valve seat and a tip wall;

an elongate check having a guide portion disposed within the guide wall, a tip portion disposed within the tip wall and a sealing portion between the guide portion and the tip portion and disposed adjacent the valve seat;

an actuator for moving the check along a selected path between a sealing position and an open position; and means carried by at least one of the check and the injector body for substantially balancing opposing axial forces acting on the check in the direction of the selected path during movement between the sealing and open positions.

2. The check valve of claim 1, wherein the check includes first and second end portions and wherein the guide portion and tip portion have substantially equal cross-sectional areas and wherein the balancing means comprises a fluid conduit which equalizes fluid pressures acting on first and second portions of the check.

3. The check valve of claim 2, wherein the fluid conduit comprises a longitudinal bore extending through the check and providing fluid communication between the tip portion and the guide portion.

4. The check valve of claim 2, wherein the tip portion of the check is disposed in a tip section of the injector bore and wherein the tip portion and the tip section each includes a cross-sectional diameter and wherein the cross-sectional diameter of the tip portion is less than the cross-sectional diameter of the tip section of the injector bore such that a leakage path is established between the valve seat and the fluid conduit.

5. The check valve of claim 2, wherein the actuator comprises a solenoid having an armature connected to the check at an end thereof and wherein the fluid conduit comprises a longitudinal bore extending through the check and a radial hole extending from the longitudinal bore through a sidewall of the check.

6. A check valve for a fuel injector, comprising:

an injector body having an injector bore including a guide bore section defined by a guide wall, a tip bore section defined by a tip wall and a valve seat disposed between the guide wall and the tip wall;

a cylindrical elongate check having a guide portion disposed within the guide wall, a tip portion disposed within the tip wall and a sealing portion between the guide portion and the tip portion and disposed adjacent the valve seat;

an actuator for moving the check along an axial path between a sealing position and an open position; and means carried by at least one of the check and the injector body for substantially balancing axial forces acting on the check during movement between the sealing and open positions.

7. The check valve of claim 6, wherein the guide portion and tip portion are disposed at first and second end portions, respectively, of the check and have substantially equal cross-sectional areas and wherein the balancing means comprises means for equalizing pressures acting on the first and second end portions of the check.

8. The check valve of claim 7, wherein the equalizing means comprises a longitudinal bore extending through the check.

9. The check valve of claim 8, wherein the actuator comprises a solenoid and further including a radial hole in fluid communication with the longitudinal bore adjacent the solenoid.

10. The check valve of claim 8, wherein the tip portion of the check has a cross-sectional diameter less than a cross-sectional diameter of the tip wall such that a leakage path is established between the valve seat and the longitudinal bore.

11. The check valve of claim 10, wherein the valve seat has an inner cross-sectional diameter equal to the cross-sectional diameter of the tip bore section.

12. A fuel injector, comprising:

an injector body having an injector bore including a guide bore section defined by a guide wall, a tip bore section defined by a tip wall and a conical valve seat disposed between the guide wall and the tip wall, an injector inlet in fluid communication with the injector bore for admittance of pressurized fuel therein, and an injector nozzle orifice in fluid communication with the injector bore;

a circular cylindrical elongate check having a guide portion disposed at a first check end portion within the guide wall, a tip portion disposed at a second check end portion within the tip wall, wherein the guide portion and tip portion have substantially equal cross-sectional areas, a sealing portion disposed between the guide portion and the tip portion and disposed adjacent the valve seat and an annular groove between the sealing portion and the tip portion wherein the tip portion is spaced from the tip wall to provide a leakage path between the annular groove and the second check end;

an actuator for moving the check along an axial path between a sealing position wherein the sealing portion is in sealed contact with the valve seat and isolates the injector nozzle orifice from the injector inlet and an open position wherein the sealing portion is spaced from the valve seat to place the injector nozzle orifice in fluid communication with the injector inlet; and means carried by at least one of the check and the injector body for equalizing pressures acting on the first and second end portions of the check such that axial forces acting on the check during movement between the sealing and open positions are substantially balanced.

13. The fuel injector of claim 12, wherein the equalizing means comprises a longitudinal bore extending through the check.

14. The check valve of claim 13, wherein the actuator comprises a solenoid and further including a radial hole in fluid communication with the longitudinal bore adjacent the solenoid.

15. The check valve of claim 14, wherein the valve seat has an inner cross-sectional diameter equal to the cross-sectional diameter of the tip portion.

* * * * *